United States Patent [19]

Wieland

[11] Patent Number: 4,682,542

[45] Date of Patent: Jul. 28, 1987

[54] WATER FOUNTAIN FOR A DAMPENING UNIT

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 860,978

[22] Filed: May 8, 1986

[30] Foreign Application Priority Data

May 30, 1985 [DE] Fed. Rep. of Germany ..... 3519294

[51] Int. Cl.[4] ..... B41F 7/32

[52] U.S. Cl. ..... 101/148; 101/364

[58] Field of Search ..... 101/148, 350, 363, 366, 101/364, 355, 360, 207, 208, 210, 157, 169, 147; 118/261, 259

[56] References Cited

U.S. PATENT DOCUMENTS

| | | | |
|---|---|---|---|
| 2,141,978 | 12/1938 | Greenhill | 101/157 |
| 2,201,452 | 5/1940 | Pollock | 101/157 |
| 2,435,452 | 2/1948 | Linn et al. | 101/350 |
| 3,045,592 | 7/1962 | Shearer et al. | 101/350 |
| 3,352,317 | 11/1967 | Dahlgren | 101/148 |
| 3,405,636 | 10/1968 | Schmidcin | 101/148 |
| 3,718,115 | 2/1973 | Lee | 118/261 X |
| 3,940,782 | 2/1976 | Neeb et al. | 101/366 |
| 4,574,695 | 3/1986 | Ryan | 101/148 |
| 4,603,632 | 8/1986 | Schneider | 101/364 |

*Primary Examiner*—J. Reed Fisher

*Attorney, Agent, or Firm*—Jones, Tullar & Cooper

[57] ABSTRACT

A water fountain for a dampening unit of an offset rotary printing machine includes spaced front rear and side walls and a bottom. A pair of spaced inlet and outlet dams each include drainage holes and overflow apertures. Dampening fluid is fed to the fountain through an infeed pipe and unused fluid exits the fountain through a drainage tube. This drainage tube is in fluid communication with, but is separate from a funnel carried in an open end of a dampening fluid recirculation pipe. The water fountain is supported between side frames of the press. Since neither dampening fluid inlet line nor the dampening fluid recirculation pipe are connected to the fountain, it can be quickly and easily removed from the dampening unit for cleaning or service.

9 Claims, 2 Drawing Figures

WATER FOUNTAIN FOR A DAMPENING UNIT

FIELD OF THE INVENTION

The present invention is directed generally to a water fountain for a dampening unit. More particularly, the present invention is directed to a water fountain for a dampening unit of an offset rotary printing machine. Most specifically, the present invention is directed to a dampening unit water fountain which is removably positioned in the printing machine with no direct connection to the dampening liquid circulation system. The water fountain has a downwardly directed drainage tube which terminates above, and which is spaced from a funnel shaped opening to a dampening fluid drainage pipe. The minimum opening size of the funnel is greater than the maximum size of the drainage tube. The water fountain is removably supported on side frame pieces of the printing machine and is not rigidly connected to the dampening liquid circulator system so that it can be quickly and easily removed from the printing machine for cleaning and servicing.

DESCRIPTION OF THE PRIOR ART

Water fountains for dampening units of offset rotary printing machines are generally known in the art. These units are typically supplied with dampening fluid such as water and a drain means is provided to return the unused dampening fluid to a dampening liquid circulation system. Fountains of this general type are used in numerous printing applications not only for dampening fluid but also for printing ink. For example, U.S. Pat. No. 3,045,592 shows a liquid applicator having a reservoir supply system and means for maintaining the reservoir at a uniform level. Such systems typically are relatively permanent in their attachments to the printing machine. Inlet and outlet tubes or conduits, which are frequently utilized for fluid supply and drainage lines, are conventionally positively secured to the liquid reservoir.

Water fountains for dampening units are apt to receive paper particles and dust from ductor rolls and other sources. These paper particles or dust settle to the bottom of the water fountain and form a sludge or mud that eventually accumulates in sufficient quantity that the water fountain must be taken out of the machine for cleaning. The positive securement and attachment of the prior art water fountains to the press frame and to the dampening fluid inlet and outlet hoses or conduits has required a substantial period of time to accomplish water fountain removal. This obviously is not an advantageous situation since the printing machine is not operational during such times when the water fountain must be removed and cleaned. A water fountain assembly which would require less time for removal, cleaning and repositioning would reduce press down time. The water fountain of the present invention accomplishes this beneficial result.

SUMMARY OF THE INVENTION

It is an object of the present invention to provide a water fountain for a dampening unit.

A further object of the present invention is to provide a water fountain for a dampening unit for an offset rotary printing machine.

Another object of the present invention is to provide a water fountain having no rigid connection to the dampening water circulation system.

Still a further object of the present invention is to provide a water fountain which is quickly removable from the printing machine.

Yet another object of the present invention is to provide a water fountain having a dampening fluid drainage tube which cooperates with a generally funnel shaped opening of a dampening fluid drainage pipe.

As will be discussed in greater detail in the description of the preferred embodiment, the water fountain for a dampening unit of an offset rotary printing machine in accordance with the present invention is generally in the shape of a rectangular reservoir having spaced inlet and outlet dams. A dampening fluid drainage outlet piece or tube extends downwardly from the floor of the fountain. This drainage tube is spaced from, and in fluid communication with a funnel shaped opening to a drainage pipe for the dampening fluid circulation system. Unused dampening fluid is thus returned to the circulation system while still allowing the water fountain to be free of connecting hoses or tubes, as was the situation with prior art devices.

The water fountain of the present invention, since it is not attached to the printing machine by any hoses or the like, can be quickly and easily removed for cleaning and servicing. Since the removal and reattachment times are so much less than those required by the prior art devices, the water fountain can be removed and cleaned during short periods of machine down time, such as those which normally occur during printing processes or production. Thus no time is specifically required to stop the operation of the printing machine for water fountain removal or cleaning.

The water fountain in accordance with the present invention is equipped with both inlet and outlet dams that have drainage openings and overflow apertures. Surfaces tension of the dampening liquid does not exert any influence on the even flow of the dampening fluid in the water fountain. This promotes even overflowing of the dams and thus an even drainage of the dampening fluid from the water fountain.

The drainage tube of the water fountain is physically separate from the dampening fluid drainage pipe and circulation system. This physical separation through an air gap eliminates the possible formation of an air lock in the outlet pipe and a resultant water fountain overflow.

The water fountain for a dampening unit is accordance with the present invention significantly reduces fountain removal and reinstallation times by doing away with any direct connections between the inlet and outlet lines of the dampening fluid unit and the dampening fluid circulation system. Even dampening fluid flow is facilitated by the fountain dam structure, and outlet pipe airlocks are avoided. The dampening unit is a substantial advance in the art and increases printing press production.

BRIEF DESCRIPTION OF THE DRAWINGS

While the novel features of the water fountain for a dampening unit of an offset rotary printing machine are set forth with particularity in the appended claims, a full and complete understanding of the invention may be had by referring to the detailed description of the preferred embodiment as set forth hereinafter and as illustrated in the accompanying drawings in which:

DESCRIPTION OF THE PREFERRED EMBODIMENT

Figure 1:
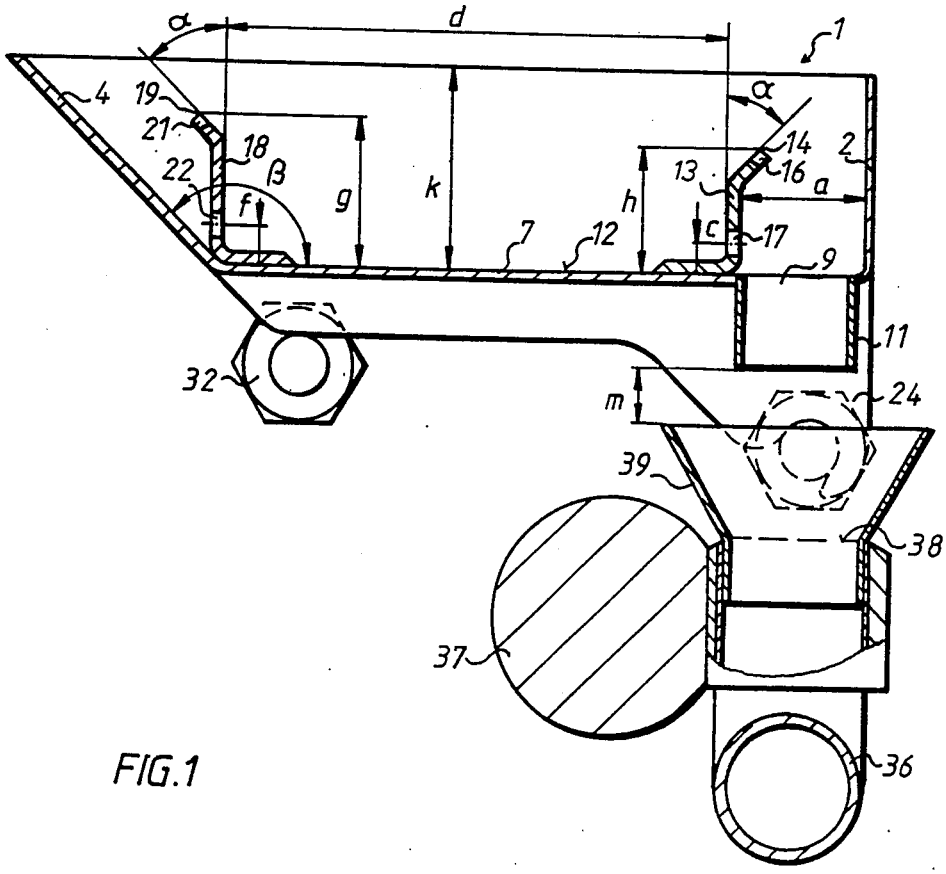
FIG. 1 is a side elevation view, partly in section of the water fountain in accordance with the present invention and taken along line I—I of FIG. 2.

Referring initially to FIG. 1, there may be seen generally at 1 a preferred embodiment of a water fountain for a dampening unit of an offset rotary printing machine in accordance with the present invention. Water fountain 1 is comprised of a front vertical wall 2, left and right vertical walls 3 and 6, respectively, an inclined rear wall 4 and a generally horizontal planar floor 7. As may be seen in FIG. 2, water fountain 1 is generally rectangular but could be square or otherwise shaped. All of the walls, 2, 3, 4 and 6 have a height "k" and inclined rear wall has an opening $\beta$ with respect to the floor 7 of generally about 135°.

Figure 2:
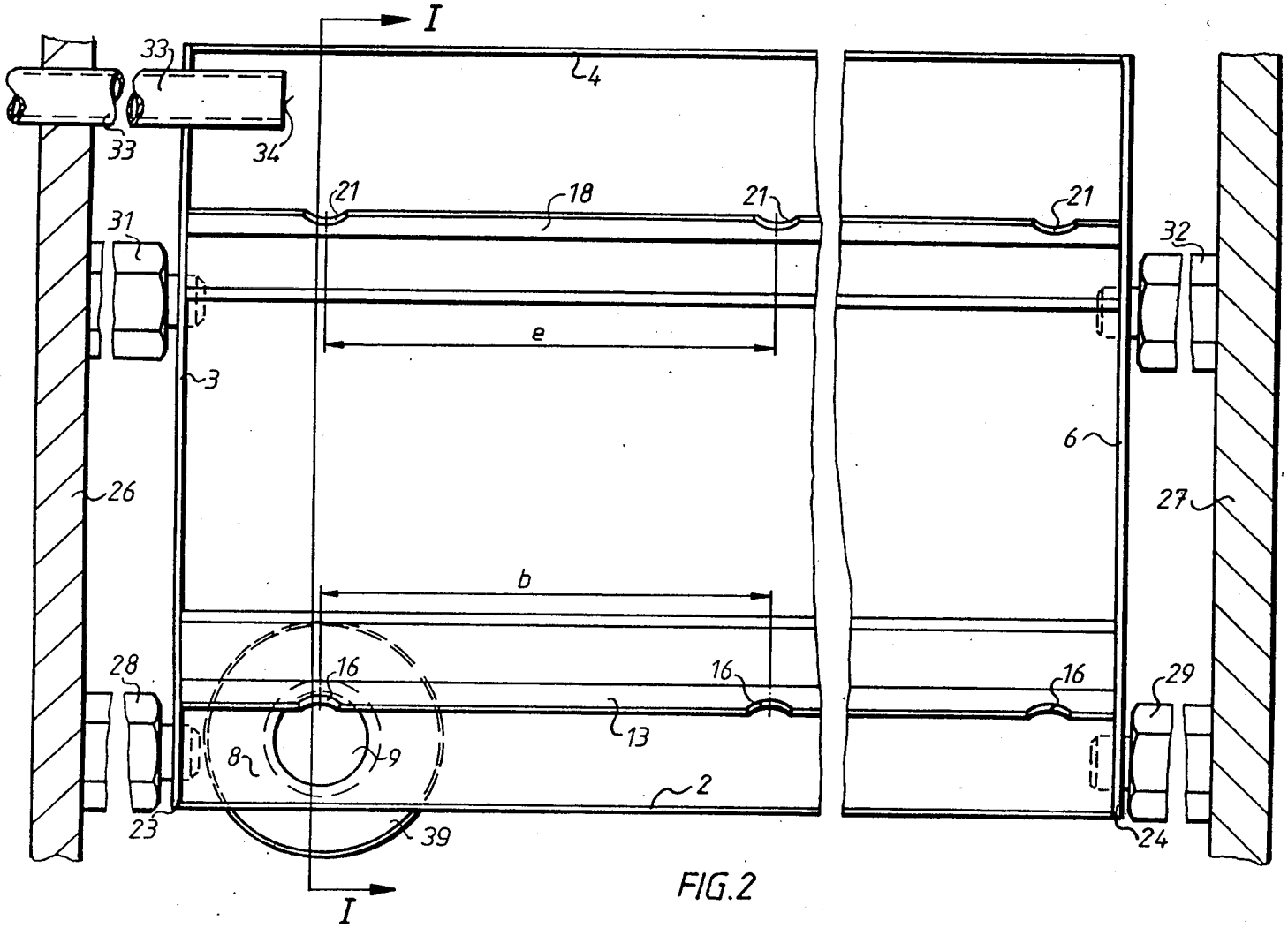
FIG. 2 is a top plan view of the water fountain of FIG. 1.

A generally vertical outlet dam 13 extends between side walls 3 and 6 and is generally parallel to front wall 2. Outlet dam 13 is spaced a distance "a" from front wall 2. An upper portion 14 of outlet dam is inclined toward front wall 2 at an angle $\alpha$ of generally about 45, as may be seen in FIG. 1. This inclined upper portion 14 outlet dam 13 is provided with a plurality of outlet dam overflow apertures 16 which, as may be seen more clearly in FIG. 2, are generally semi-circular in shape and are spaced along the upper edge of upper part 14 of outlet dam 13 at a distance "b" from each other. A plurality of outlet drainage holes 17 are formed in the vertical wall of outlet dam 13 at a height "c" above an inner surface 12 of fountain floor 7.

An inlet dam 18 extends across water fountain 1 between left and right side walls 3 and 6 generally adjacent rear wall 4. Inlet dam 18 is generally parallel to outlet dam 13 and is spaced therefrom at a distance "d" which, in the preferred embodiment is generally about 8 cm. An upper portion 19 of inlet dam 18 is angled toward rear wall 4 at an angle $\alpha$ of generally about 45°. A plurality of inlet dam overflow apertures 21 are provided along an upper edge portion of upper portion 19 of inlet dam 18. These inlet dam overflow apertures 21 are spaced from each other at a distance "e" which, in the preferred embodiment, is generally about 20 cm. A plurality of small inlet dam drainage holes 22 are located in the lower portion of inlet dam 18 at a height "f" above fountain floor 7.

A circular drainage hole 9 is formed in floor 7 of water fountain 1 and is located in a front left corner 8 of fountain floor 7 generally adjacent to the intersection of left side wall 3 and front wall 2. This hole is also located between outlet dam 13 and front wall 2. A drainage connection piece or drainage tube 11 is welded or otherwise secured in floor drainage hole 9. An upper end of drainage tube 11 is situated flush with the upper surface 12 of fountain floor 7 and drainage tube 11 extends downwardly away from fountain 1. In the preferred embodiment, drainage tube 11 is generally about 15 mm in length, has a diameter of 20 mm and a wall thickness of 1 mm.

As may be seen in FIG. 2, a dampening liquid inlet feed line or pipe 33 is secured to a left side frame 26 of the printing press. An opening 34 of inlet feed line or pipe 33 is situated over water fountain 1 between inlet dam 18 and inclined rear wall 4. Inlet feed line 33 delivers dampening fluid from a dampening fluid circulation system (not shown) to the space between inlet dam 18 and rear wall 4. The rate of dampening fluid infeed is greater than the rate at which dampening fluid can flow through the plurality of inlet dam drainage holes 22 in inlet dam 18. Thus dampening fluid builds up in the space between inlet dam 18 and rear wall 4. Inlet dam has a height "g" which is less than the height "k" of the fountain walls 2, 3, 4 and 6. Thus when dampening fluid reaches the top of inlet dam 18, it overflows through the inlet dam overflow apertures 21 and into the space between inlet dam 18 and outlet dam 13 where it combines with the dampening fluid that has passed into this same space through inlet dam drainage holes 22.

As the dampening water builds up in the fountain 1 between inlet and outlet dams 18 and 13, respectively, it flows through outlet dam drainage holes 17 and eventually over the top of outlet dam 13 through the outlet dam overflow apertures 16. It will be noticed that the height "h " of the outlet dam 13 is less than the height "g" of inlet dam 18 to insure that dampening fluid will flow in the proper direction.

Dampening fluid which passes through outlet dam drainage holes 17 and through outlet dam overflow apertures 16 enters the space between outlet dam 13 and front wall 2. From there, it flows down drainage tube 11 and into an upper end 38 of a drainage recirculation pipe 36 that is securely attached to a transverse frame member 37, as may be seen in FIG. 1. A drainage funnel 39 is positioned within the upper end 38 of recirculation pipe 36 with the upper lip of funnel 39 being spaced a distance "m" below the lower end of drainage tube 11. Funnel 39 and recirculation pipe 36 are both sized to be larger in diameter than drainage pipe 11 so that there will be no possibility of spillage of dampening fluid. Recirculation pipe 36 returns the dampening fluid to the commercially available dampening fluid circulation system (not shown) where it is returned to dampening fluid infeed pipe 33. If the flow of dampening fluid is stopped, the dampening fluid will drain from behind inlet and outlet dams 18 and 13, respectively and to drainage tube 11.

Left and right side walls 3 and 6, respectively extend down beneath the level of water fountain floor 7, as may be seen in FIG. 1. These side wall extensions are provided with generally hook shaped receptacles 23 and 24 that are located generally beneath front wall 2, as may be seen in FIG. 1. Receptacles 23 and 24 support the front portion of water fountain 1 by being placed atop front support bolts 28 and 29 which extend inwardly through side frames 26 and 27, respectively, as may be seen most clearly in FIG. 2. The rear portions of the extensions of side walls 3 and 6 are generally horizontal and rest on inwardly directed rear support bolts 31 and 32 that are also directed inwardly of side frames 26 and 27, respectively. It will thus be seen that water fountain 1 can be quickly removed for cleaning or servicing merely by elevating rear wall 4 slightly and disengaging the hook shaped receptacles 23 and 24 from the front support bolts 28 and 29. Since the dampening fluid inlet line 33 is not positively secured to fountain 1 and further since the dampening fluid drainage tube 11 is not secured to funnel 39, fountain 1 is quickly and easily removed from the offset rotary printing machine for cleaning or the like. Thus, as was discussed previously, the water fountain 1 can be removed, cleaned and replaced at any time when the rotary printing machine is shut down for normal process or printing changes. This increases press productivity since a separate time period is no longer required for disconnection and removal of the water fountain as was the case with prior art devices. The water fountain 1 in accordance with the present invention can be removed from the dampening unit easily and without the need of any tools.

While a preferred embodiment of a water fountain for a dampening unit of an offset rotary printing machine has been set forth fully and completely hereinabove, it will be obvious to one of skill in the art that a number of changes in, for example the size of the fountain, the type of dampening fluid used, the type of printing machine and the like could be made without departing from the true spirit and scope of the subject invention which is to be limited by the following claims.

What is claimed is:

1. A removable water fountain and dampening unit for an offset rotary printing machine, said water foutain and dampening unit comprising:

a front wall, a rear wall and spaced side walls, said front, rear, and side walls extending generally upwardly from a floor to define a dampening fluid receiving reservoir in said removable water fountain;

spaced, generally parallel inlet and outlet dams extending between said spaced side walls;

means for supplying dampening fluid to said water fountain reservoir from a dampening fluid circulation system and means for returning unused dampening fluid to said dampening fluid circulation system from said fountain reservoir, said means for supplying said dampening fluid to said water fountain reservoir including a dampening fluid inlet feed line positioned above, and spaced from said water fountain reservoir, said means for returning said unused dampening fluid from said water fountain reservoir to said dampening fluid circulation system including a drainage tube secured in said floor of said water fountain;

a drainage pipe in said dampening fluid circulation system, said drainage pipe having a funnel in an opening thereof, a mouth portion of said funnel being positioned beneath, and spaced from said drainage tube to receive said unused dampening fluid from said drainage tube and to return said unused dampening fluid to said dampening fluid circulation system, said funnel and said drainage pipe being of greater cross section at all points that an outlet cross section of said draingage tube; and means for supporting said removable water fountain in said offset rotary printing machine for quick, connection free removal and reinstallation of said water fountain in said dampening unit.

2. The water fountain of claim 1 wherein each of said inlet and outlet dams has a plurality of spaced overflow apertures along an upper edge portion.

3. The water fountain of claim 1 wherein each of said inlet and outlet dams has a plurality of spaced drainage holes along a lower portion thereof.

4. The water fountain of claim 1 wherein said inlet dam has an inclined upper portion and further wherein said rear wall is inclined, said angles of inclination of said inlet dam upper portion and said rear wall being generally about the same whereby said inclined inlet dam wall and said rear wall are generally parallel.

5. The water fountain of claim 1 wherein said outlet dam includes an inclined upper wall portion which is inclined at an angle of generally about 45° with respect to said front wall.

6. The water fountain of claim 1 wherein said dampening fluid return means is positioned intermediate said outlet dam and said front wall.

7. The water fountain of claim 1 wherein said dampening fluid supply means is positioned above and between said inlet dam and said rear wall.

8. The water fountain of claim 1 wherein said spaced side walls extend downwardly below the level of said floor and further wherein generally hook shaped receptacles are formed in portions of said side walls which underlie said front wall.

9. The water fountain of claim 8 wherein said hook shaped receptacles cooperate with bolt means secured to side frames of said printing machine to provide said means for supporting said water fountain in said dampening unit.

* * * * *